US011696657B2

(12) United States Patent
Huang

(10) Patent No.: US 11,696,657 B2
(45) Date of Patent: Jul. 11, 2023

(54) MULTI-FUNCTION CUP COASTER

(71) Applicant: Inluxe LLC, Beverly Hills, CA (US)

(72) Inventor: Yu Jane Huang, Beverly Hills, CA (US)

(73) Assignee: Inluxe LLC, Beverly Hills, CA (US)

( * ) Notice: Subject to any disclaimer, the term of this patent is extended or adjusted under 35 U.S.C. 154(b) by 0 days.

(21) Appl. No.: 17/403,567

(22) Filed: Aug. 16, 2021

(65) Prior Publication Data

US 2022/0079361 A1 Mar. 17, 2022

Related U.S. Application Data

(60) Provisional application No. 62/706,887, filed on Sep. 16, 2020.

(51) Int. Cl.

| | |
|---|---|
| ***A47G 19/00*** | (2006.01) |
| ***A47G 19/22*** | (2006.01) |
| ***A47G 23/02*** | (2006.01) |

(52) U.S. Cl.

CPC ..... *A47G 19/2227* (2013.01); *A47G 23/0216* (2013.01); *A47G 2019/2238* (2013.01)

(58) Field of Classification Search

None

See application file for complete search history.

(56) References Cited

U.S. PATENT DOCUMENTS

| | | | | |
|---|---|---|---|---|
| 6,082,866 | A * | 7/2000 | Amedee | A47G 23/0309 362/101 |
| 6,164,793 | A * | 12/2000 | Wu | F21V 33/00 362/101 |
| 6,793,363 | B2 * | 9/2004 | Jensen | A47G 23/0309 362/101 |
| 7,766,293 | B2 * | 8/2010 | Seidl | A47C 1/12 248/311.2 |
| 9,874,340 | B2 | 1/2018 | Chien | |
| 10,213,032 | B1 * | 2/2019 | Fontaine-Cole | B65D 25/2811 |
| 10,295,400 | B2 * | 5/2019 | Wallace | G01G 23/3735 |
| 2015/0017071 | A1 * | 1/2015 | McMinn | A61L 9/032 29/428 |
| 2016/0045049 | A1 * | 2/2016 | Kim | G01G 19/52 248/550 |
| 2017/0354282 | A1 | 12/2017 | Sanchez, III | |
| 2019/0242562 | A1 | 8/2019 | Chien | |

FOREIGN PATENT DOCUMENTS

| | | | |
|---|---|---|---|
| WO | 2020/159393 | A1 | 8/2020 |

* cited by examiner

*Primary Examiner* — Steven M Marsh

(74) *Attorney, Agent, or Firm* — Fish IP Law, LLP

(57) ABSTRACT

A multi-functional coaster for a cup or other vessel includes a base upon which the vessel can rest upside down, and a decorative body extending away from the base. The decorative body has at least a first electrically powered signal emitter, which preferably include a light emitter and a sound emitter. The decorative body and/or base can also include a fragrance emitter.

14 Claims, 3 Drawing Sheets

300

400

500

MULTI-FUNCTION CUP COASTER

This application claims priority to U.S. Provisional Application Ser. No. 62/706,887 filed on Sep. 16, 2020, and Chinese patent application number 202023078532.7, filed on Dec. 20, 2020. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

The utility model relates to the technical field of drink coasters, in particular to a multi-functional coaster.

BACKGROUND

The following description includes information that may be useful in understanding the present invention. It is not an admission that any of the information provided herein is prior art or relevant to the presently claimed invention, or that any publication specifically or implicitly referenced is prior art.

Drink coasters are generally used to provide a resting spot for a cup, mug, or other drink container. For the most part, they are simple mechanical devices. Other than perhaps providing decoration, known coasters offer little more than a resting spot for a cup, glass or other vessel, and protection for the underlying tabletop or other surface. It is contemplated herein that drink coasters could advantageously provide electronically-operated visual, auditory, and/or olfactory signals.

U.S. Pat. No. 9,874,340 (Chien) teaches an LED light device that can include function that appeals to a person's eye, nose and ear. The device can be used as an ornament.

US 2019/0242562 (Chien) teaches a desk having the LED device of U.S. Pat. No. 9,874,340, capable of making light, sound and fragrance when the person is close proximity to the desk (LED device).

US20170354282 (Sanchez) teaches an elevated coaster, in which a tray-type base provides space to house food or other items. One could presumably put an electronic device in the base, but there is no teaching, suggestion or motivation in the application for doing so.

WO2020159393 (Chien) teaches a desktop power station that provides power for multiple different types of devices, including for example, LED lighting, a clock, a projector, a digital photo frame, an air freshener, and a cooler or heater. The power station can also provide lighting and sound, apparently independently of the devices to which it supplies power. There is no teaching, suggestion or motivation in the application for providing those features in a drink coaster, and no teaching, suggestion or motivation in the application for triggering those features upon tactile engagement with an object.

Thus, there is still a need for a drink coaster that provides lighting, sound, and/or fragrance.

SUMMARY OF THE INVENTION

The inventive subject matter provides apparatus, systems and methods in which a coaster for a drinking vessel emits light, sound, and/or fragrance, preferably upon placing the vessel upon, or removing the vessel from, the coaster.

In preferred embodiments, that coaster is configured to emit each of light, sound, and fragrance, either concurrently or using one or more time delays.

Also in preferred embodiments, the coater has a base and a decorative body that extends away from the base. One or more of the emitters can be positioned on the decorative body.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Figure 1:
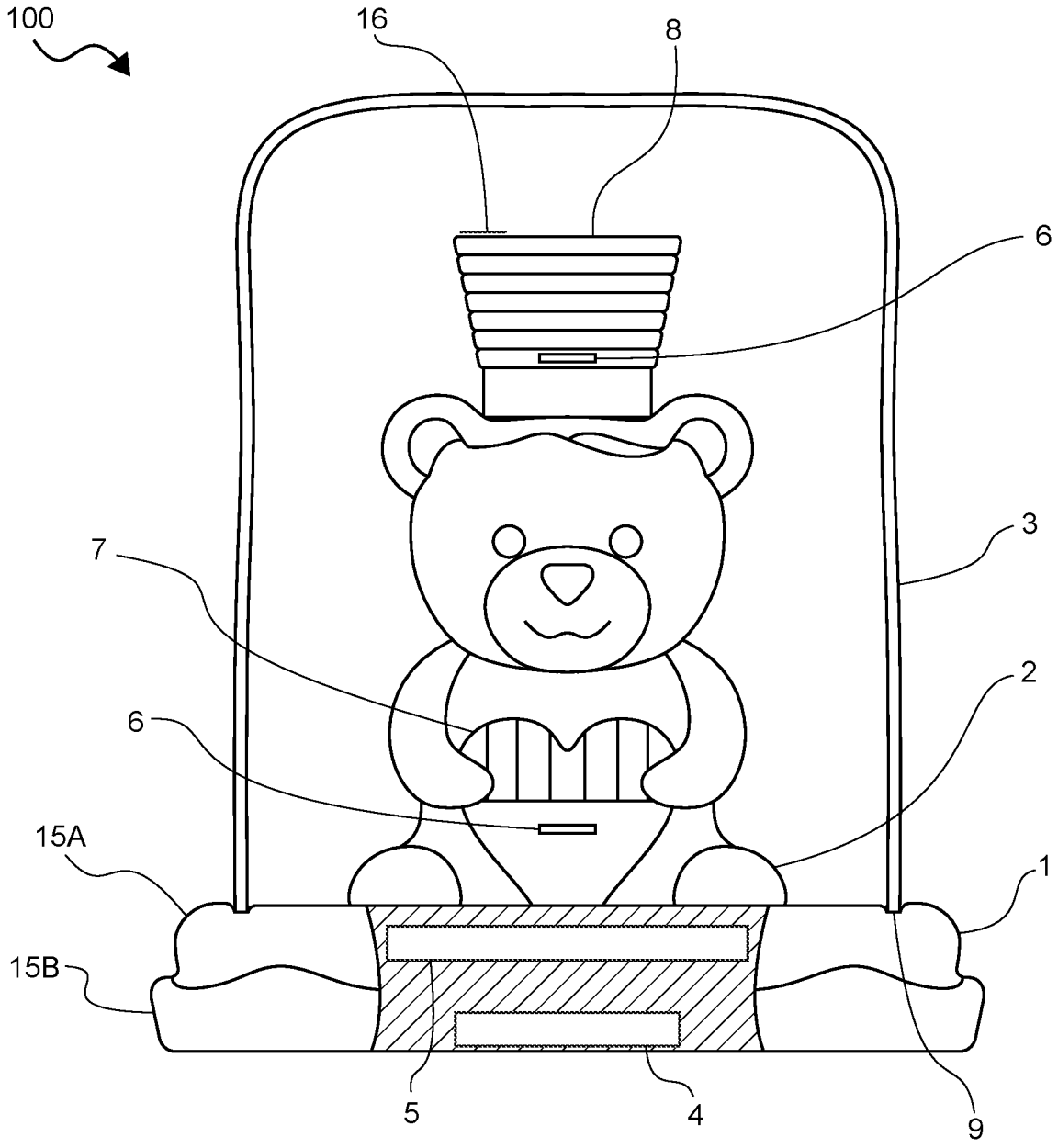
FIG. 1 is a side view of the coaster, upon which a transparent cup is positioned upside down on a base. A decorative body in the shape of a cartoon bear extends upwards from the base.

FIG. 1 generally depicts a vessel 3 positioned upside down on a coaster 100, with the coaster 100 generally comprising a base 1, and a decorative body 2 that extends upwards from the base.

The base 1 includes a battery 4, and a circuit 5. Base 1 has a ring-shaped recess 9 configured to receive an edge of the vessel 3. Base 1 is preferably made from one or more polymers, with an upper portion 15A being softer than a lower portion 15B, to provide cushioning to the vessel 3. The base can also include a fragrance emitter (not shown).

Figure 3:
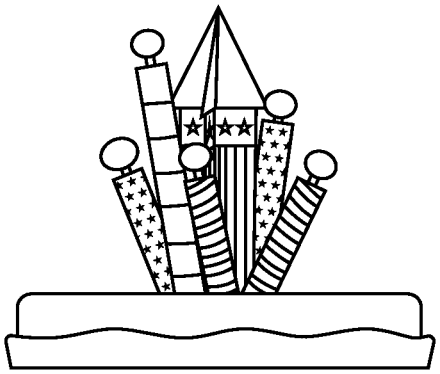
FIG. 3 depicts an alternative configuration, in which the decorative body extending away from the base is a collection of fireworks.
Figure 4:
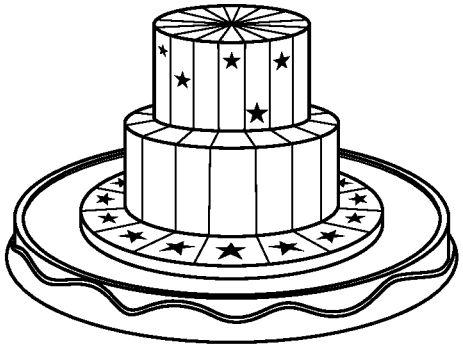
FIG. 4 depicts an alternative configuration, in which the decorative body extending away from the base is a cake.
Figure 5:
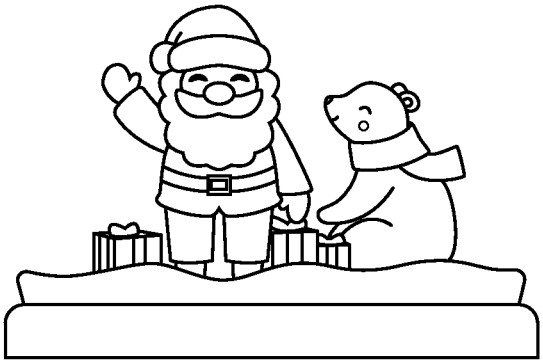
FIG. 5 depicts an alternative configuration, in which the decorative body extending away from the base is a Santa and bear.

The decorative body 2 includes two light emitter 6, a sound emitter 7, a fragrance emitter 8, and a solar panel 16. Wires (not shown) provide power from the circuit 5 to the various emitter 6, 7, 8. Decorative body 2 is preferably attached to the base by glue, but could be molded as a continuous piece with the base 1. In FIG. 1, the decorative body is a cartoon bear, but all other suitable shapes are contemplated. FIGS. 3, 4, and 5 show coasters 300, 400, 500 having features described herein with respect to coaster 100, except that the decorative body 310 of coaster 300 is shaped as a collection of fireworks, the decorative body 410 of coaster 400 is shaped as a collection of cake, the decorative body 510 of coaster 500 is shaped as a Santa and bear.

In an alternative configuration, the decorative body has substantially flat opposing surfaces rather than being a 3D object. The coaster is positioned for use 90° from that disclosed for coaster 100, such that the decorative body is horizontal, and acts as a seat upon which a cup or other vessel can be placed.

It should be appreciated that the ornamentation present on, or otherwise comprising, the cup cushion can include any human, animal or other character, imaginary or real, or any other object, imaginary or real, animate or inanimate, or any combination thereof, and can be any combination of 2D and 3D imagery. Similarly, it should be appreciated that any part of the cup cushion can be constructed of any suitable material or materials. Still further, it should be appreciated that the coaster is attached to the top ornament, and the ornament can comprise any shape.

Figure 2:
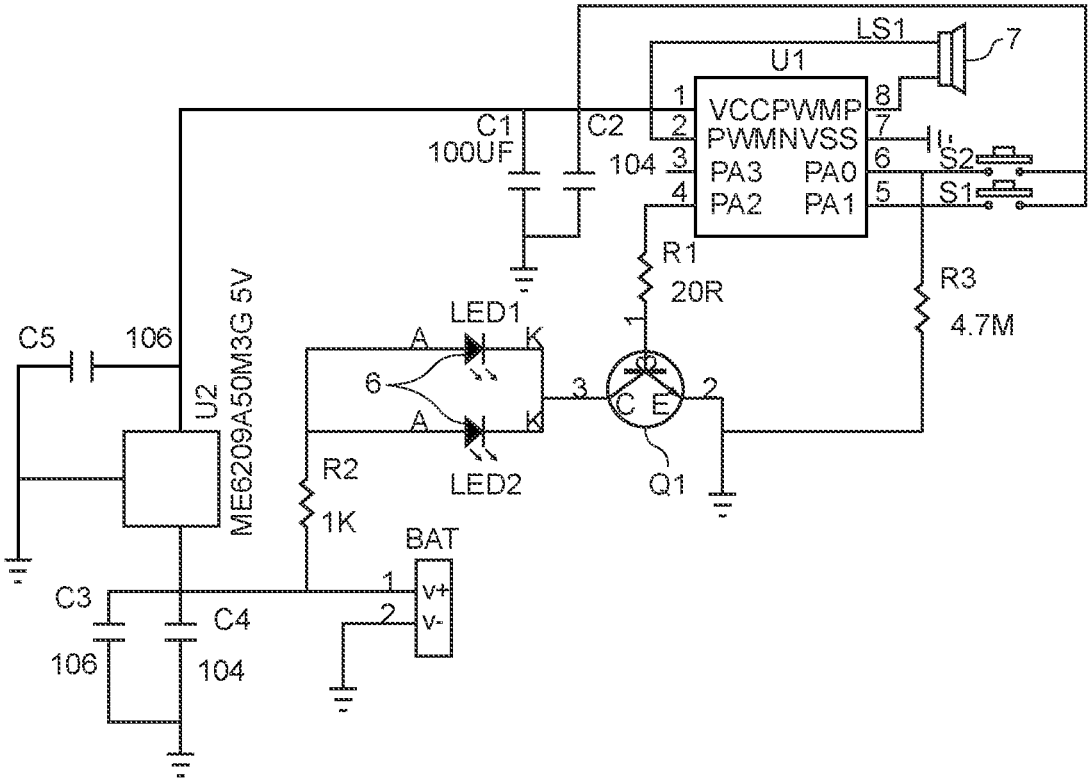
FIG. 2 is a circuit diagram configured to operate one or more of the signal emitters.

FIG. 2 depicts an exemplary circuit 200 that could be used for operating the two light emitting diodes 6 and the sound emitter 7 of coaster 100. Circuit 200 generally comprises a main control chip U1, a power chip U2, battery BAT, first and second touch switches S1, S2, LEDs 6, sound emitter 7, semiconductor Q1, and various capacitors C1-C5, and resistors R1-R3. The battery can advantageously comprise one or more button batteries, including for example two 2032 coin cells. Power can be supplied by any suitable power source or combinations of power sources, including solar. Also, all suitable switches are contemplated, including for example manual switches, and those that can be operated by motion (e.g., dropping or shaking), changes in light, temperature, composition of ambient air, etc.

It should be appreciated that power can be supplied by any suitable power source or combinations of power sources, including solar. Also, all suitable switches are contemplated, including for example manual switches, and those that can be operated by motion (e.g., dropping or shaking), changes in light, temperature, composition of ambient air, etc.

Also, it should be appreciated that the ornamentation present on, or otherwise comprising, the cup cushion can include any human, animal or other character, imaginary or real, or any other object, imaginary or real, animate or inanimate, or any combination thereof, and can be any combination of 2D and 3D imagery. Accordingly, the ornament can comprise any shape. Still further, it should be appreciated that any part of the cup cushion can be constructed of any suitable material or materials.

FIG. 3 depicts an alternative configuration, in which the decorative body extending away from the base is a collection of fireworks.

FIG. 4 depicts an alternative configuration, in which the decorative body extending away from the base is a cake.

FIG. 5 depicts an alternative configuration, in which the decorative body extending away from the base is a Santa and bear.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A coaster for a cup, glass or other drinking vessel, comprising;

a coaster base;

a decorative body extending away from the base, and having at least a first electrically powered signal emitter; and a switch disposed in at least one of the base and the body, and configured to activate the first signal emitter when the vessel is moved relative to the base.

2. The coaster of claim 1, wherein the first signal emitter is selected from the group consisting of an electrically powered light emitter, an electrically powered sound emitter, and an electrically powered fragrance emitter.

3. The coaster of claim 2, further comprising a second signal emitter, different from the first signal emitter, and selected from the group consisting of an electrically powered light emitter, an electrically powered sound emitter, and an electrically powered fragrance emitter.

4. The coaster of claim 3, further comprising a third signal emitter, different from each of the first and second signal emitters, and selected from the group consisting of an electrically powered light emitter, an electrically powered sound emitter, and an electrically powered fragrance emitter.

5. The coaster of claim 2, further comprising a circuit configured to cooperate with the switch to activate at least one of the first and second signal emitters using a time delay following the vessel being moved relative to the base.

6. The coaster of claim 1, wherein the first signal emitter comprises an electrically powered light emitter, and further comprising a second electrically powered sound emitter, and an electrically powered fragrance emitter.

7. The coaster of claim 1, wherein the first signal emitter is powered by a battery disposed in the base.

8. The coaster of claim 1, wherein the switch is configured to activate the first signal emitter when the vessel is placed upon the base, and when the vessel is removed from the base.

9. The coaster of claim 1, further comprising a circuit configured to cooperate with the switch to activate the first signal emitter using a time delay following the vessel being moved relative to the base.

10. The coaster of claim 1, wherein the decorative body is configured to appear as an animal.

11. The coaster of claim 1, further comprising a battery configured to provide electrical power to the first signal emitter.

12. The coaster of claim 1, further comprising a photocell configured to provide electrical power to the battery.

13. The coaster of claim 1, wherein the at least one of the base and the decorative body comprises a polymer.

14. The coaster of claim 1, wherein the base has a ring-shaped recess configured to receive an edge of the vessel.

* * * * *